United States Patent [19]

Sneed

[11] Patent Number: 4,762,043

[45] Date of Patent: Aug. 9, 1988

[54] LONG WEARING PUNCH

[75] Inventor: Sonny Sneed, Akron, Ohio

[73] Assignee: Jacob L. Reich, Akron, Ohio

[21] Appl. No.: 28,783

[22] Filed: Mar. 23, 1987

[51] Int. Cl.[4] ..... B26F 1/14

[52] U.S. Cl. ..... 83/688; 83/686

[58] Field of Search ..... 83/686, 684, 669, 670, 83/688; 407/18, 19, 13; 76/DIG. 2, 101 R, 101 B, 107 R

[56] References Cited

U.S. PATENT DOCUMENTS

| | | | |
|---|---|---|---|
| 295,227 | 3/1884 | Briggs, et al. | 83/688 |
| 1,318,489 | 10/1919 | Donaldson | 407/13 |
| 1,441,502 | 1/1923 | Hook | 407/13 |
| 2,209,025 | 7/1940 | Kaplan et al. | 407/18 |
| 2,522,440 | 9/1950 | Freter | 164/124 |
| 3,143,026 | 8/1964 | Akerson | 83/686 |
| 3,988,955 | 11/1976 | Engel et al. | 83/661 |
| 4,273,015 | 6/1981 | Johnson | 83/670 |

*Primary Examiner*—E. R. Kazenske
*Assistant Examiner*—Eugenia A. Jones
*Attorney, Agent, or Firm*—Reese Taylor

[57] ABSTRACT

An improved punching tool having a long wearing characteristic and characterized in having at least first and second punching edges disposed on the leading end of the punch body wherein these punching edges are separated by an annular groove and wherein the trailing punching edge is slightly smaller in diameter than the leading punching edge.

3 Claims, 1 Drawing Sheet

LONG WEARING PUNCH

BACKGROUND OF THE INVENTION

This invention relates in general to a metal working punch for the cold working of metal and relates in particular to a punch with an improved punching head suitable for increasing the life of the tool.

DESCRIPTION OF THE PRIOR ART

In the cold working of metal, it is known that a machining operation called punching or piercing can be accomplished wherein a punch or similar tool is used to remove metal by axial cutting and wherein the punch is pushed through the material to remove the unwanted material. There are many uses for this machining operation and tool such as, for example, making the first rough punch out of material for nuts or similar articles.

The prior art discloses a variety of such punches. For example, Briggs U.S. Pat. No. 295,227 illustrates a punch having successively larger punching edges which are joined by curved edges so that the leading or smallest punch can bend the remaining portion of the metal to be removed by the next succeeding cutting edge.

Freter U.S. Pat. No. 2,522,440 also discloses a combination of a piercing punch and a broaching and planishing member in a single tool wherein the successively arranged metal working surfaces accomplish the successive operations as the tool is forced through the workpiece. Punching is also known in other fields other than metal working, as can be seen from Akerson U.S. Pat. No. 3,143,026, and is also done in a rotary fashion, as can be seen in Johnson U.S. Pat. No. 4,273,015.

The broaching art is also of some interest in that broaching also involves the removing of metal by reciprocating the tool with respect to the workpiece. Some examples of the broaching art can be seen in Donaldson U.S. Pat. No. 1,318,489 and Hook U.S. Pat. No. 1,441,502.

In the punching or piercing art, however, certain problems are encountered which the present invention is intended to overcome.

Specifically, these punches generally have a punching head which engages the workpiece and is forced, in an axial direction, through the workpiece thereby removing the metal in its path. One specific problem is that the punches wear during use and reach a stage where they no longer effectively perform their designed operation. At that point, it is necessary to stop the production operation and replace the punch. The difficulties presented here are obvious. First, down time is encountered, which is obviously uneconomical, and secondly the punches are relatively expensive and their constant replacement raises the overall manufacturing cost to the manufacturer.

BRIEF SUMMARY OF THE INVENTION

It has been found, however, that an improved punch can be designed so as to overcome, at least to a certain extent, the "wear" difficulties ordinarily encountered and just referred to.

It has been found that the life of the punch can be extended up to three to four times the life of a conventional punch, thereby enabling the tooling to be operated continuously for a much longer time without any down time and without the cost of replacing the worn punch.

It is, accordingly, an object of this invention to provide such an improved long wearing punch.

In accomplishing this object, it has been found that if at least two punching edges are provided on the front end of the punch, the practical life of the punch can be extended considerably. It has been found that if the leading punch edge has a slightly larger diameter than the trailing punch edge, the leading punch will function in its designed fashion for a period of time and, upon becoming worn, the second punch edge can be then brought into engagement with the workpiece to continue the punching operation, thereby extending the operative life of the set up and eliminating down time and the cost of replacing the punch.

It has also been found that the first and second punching edges can be separated by an annular groove. These punches are typically coated or plated with hardened material which will, as the punch wears, on occasion chip or peel off. Separating the first and second punching edges by the annular groove insures that if the leading punching edge suffers any peeling or damage to its coating, that damage will not be communicated to the trailing punching edge.

It also will be understood, of course, that while the invention has just been described as having a first and second punching edge, it is not intended to be so limited and that more than two can be employed.

It, accordingly, becomes the principal object of this invention to provide an improved, long wearing punch of the character described with other objects thereof becoming more apparent upon a reading of the following brief specification considered and interpreted in view of the accompanying drawings.

BRIEF DESCRIPTION OF THE PREFERRED EMBODIMENTS

Figure 1:
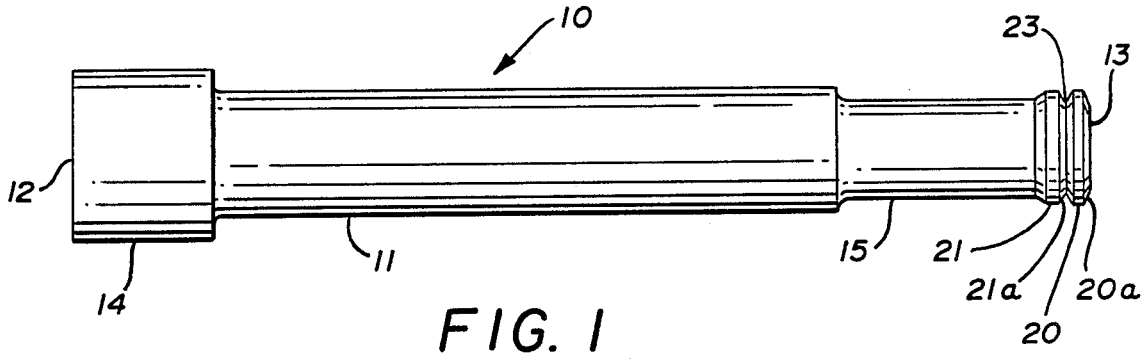
FIG. 1 is an elevational view, showing the improved punch.

Referring first then to FIG. 1 of the drawings, it will be seen that the improved punch, generally indicated by the numeral 10, is a tool generally having an elongate, cylindrical configuration with opposed first and second ends 12 and 13, a main body portion 11, an enlarged portion 14 adjacent to first end 12 and a reduced diameter portion 15 adjacent the second end 13.

It will be understood that a punch or piercing tool of this type will generally be employed in a press and that the enlarged body portion 14 is designed for releasable attachment to the punch holder of the press in conventional fashion. No specific detail regarding this arrangement will be set forth herein, since the means for attaching a tool of this type to a press or press brake is well-known to those of ordinary skill in this art.

Figure 2:
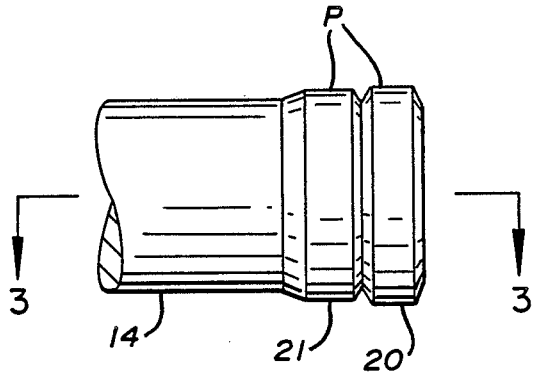
FIG. 2 is a partial elevational view enlarged and partly broken away, showing the cutting edges of the improved punch.
Figure 3:
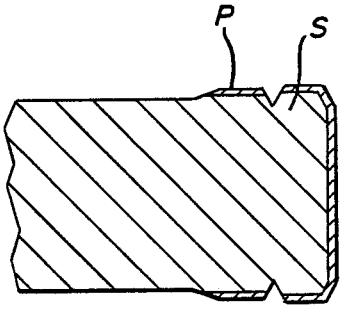
FIG. 3 is a sectional view taken along the line 3—3 of FIG. 2.

Referring then to FIGS. 1 and 2, it will be noted that the second end 13 of the tool 10 has a first punching edge 20 and a second punching edge 21. These edges are essentially similar in design in that they take the form of enlarged diameter portions extending beyond the diameter of portion 15 of the tool. In each case, the leading edges have a chamfer 20*a* and 21*a* and, with reference to FIGS. 2 and 3 of the drawings, each of these is coated with a plating P over the high speed steel S which comprises the basic material of the tool 10.

The first and second punching edges 20 and 21 are separated by an annular groove 23. It will be understood then that, as previously mentioned, as the punching edge 20, for example, is employed to punch out the material from the workpiece that, at some point during its working life, the plating P is susceptible to chipping or peeling. The fact that the annular groove 23 separates the first punching edge 20 from the second punching edge 21 limits this damage to the first punching edge.

It will also be noted that the second punching edge 21 preferably has a slightly smaller diameter than the first punching edge 20. The purpose of this design is, of course, to prevent any damage or wear to the second punching edge 21 until such time as the first punching edge 20 becomes inoperative due to wear.

In use or operation of the improved tool, it will be understood that the enlarged body portion 14 would be secured in the punch holder of the press and the tool would then be operated in conjunction with a punching die to punch out the parts being machined by reciprocating the punch with respect to the workpiece. After a certain number of repetitive machine operations, the first punching edge 20 would become worn and be reduced in diameter to the extent that it was no longer capable of performing satisfactorily. No change whatsoever is required at this point, nor is it necessary in any way to cease the manufacturing operation. The second punching edge 21 simply takes over and continues to operate on the workpieces as they are fed into the press. This eliminates down time and also eliminates the expense of replacing the punch.

While a full and complete description of the invention has been set forth in accordance with the dictates of the Patent Statutes, it should be understood that modifications can be resorted to without departing from the spirit hereof or the scope of the appended claims.

For example, as previously noted, the punch is not intended to necessarily be limited to first and second punching edges and could conceivably have more. The punch has also been described generally in a metal working environment, but may well have utility in working other materials.

It will also be understood that, while the first and second punching edges are illustrated as being circular, other configurations are possible depending on the particular requirements of the machining job.

What is claimed is:

1. A tool for use with a punching press for punching holes in workpieces, comprising:

(a) an elongate body having first and second ends;

(b) said first end having means for releasable engagement by the punching press and said second end having a working surface to engage the workpiece to be punched;

(c) said working surface comprising at least first and second punching edges (1) formed on said second end of said body; and (2) disposed in axially spaced relationship thereon; and (d) said first punching edge being formed on the leading end of said second end of said body and said second punching edge having a diameter less than the diameter of said first punching edge; said first punching edge engaging the workpiece in advance of engagement therwith by said second punching edge.

2. The tool of claim 1 wherein said first and second punching edges are separated by a recessed annular groove.

3. The tool of claim 2 wherein said first and second punching edges are plated with hardened material; the plating of said first and second punching edges being separated by said annular groove.

* * * * *